United States Patent [19]

Koch et al.

[11] Patent Number: 4,503,764

[45] Date of Patent: Mar. 12, 1985

[54] PRESS INSTALLATION

[75] Inventors: Klaus Koch, Laatzen; Gerhard Syrbius, Grossburgwedel, both of Fed. Rep. of Germany

[73] Assignee: Hermann Berstorff Maschinenbau GmbH, Hannover, Fed. Rep. of Germany

[21] Appl. No.: 561,930

[22] Filed: Dec. 15, 1983

[30] Foreign Application Priority Data

Dec. 24, 1982 [DE] Fed. Rep. of Germany ..... 3248059

[51] Int. Cl.[3] ..... B30B 9/14

[52] U.S. Cl. ..... 100/117; 100/150

[58] Field of Search ..... 100/37, 117, 145, 146, 100/147, 148, 149, 150, 93 S; 366/77, 89, 90

[56] References Cited

U.S. PATENT DOCUMENTS 4,024,168 5/1977 Homann et al. ..... 100/117 X
4,361,081 11/1982 Howard ..... 100/93 S
4,429,628 2/1984 Koch et al. ..... 100/117

FOREIGN PATENT DOCUMENTS 2092014 8/1982 United Kingdom ..... 100/117

*Primary Examiner*—Peter Feldman
*Attorney, Agent, or Firm*—Schwartz, Jeffery, Schwaab, Mack, Blumenthal & Koch

[57] ABSTRACT

The press installation includes a screw rotatably mounted in a cylinder. A very high pressure is produced to separate liquids from a mixture, with the separated liquid being drained off through bore holes in stationary pins at the location where it is released. In the discharge zone, the screw is devoid of threads whereby the annular cross sectional area between the screw core and the cylinder is increased. This extends the retention time and thus the amount of dehydration of the material as it passes through the discharge zone. Additionally provided in the discharge zone are annular offsets around the screw core in the vicinity of the pins, which prevent the penetration of solids into the drainage bore holes.

5 Claims, 3 Drawing Figures

Fig.3
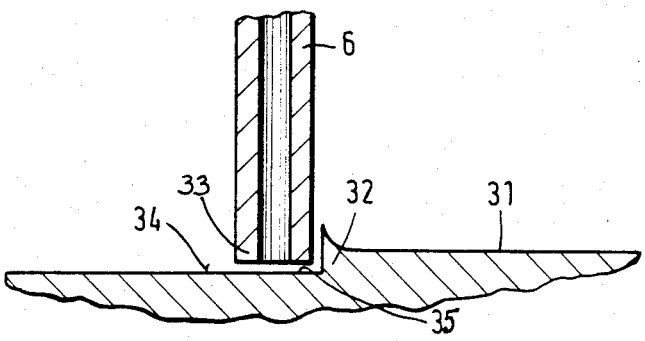
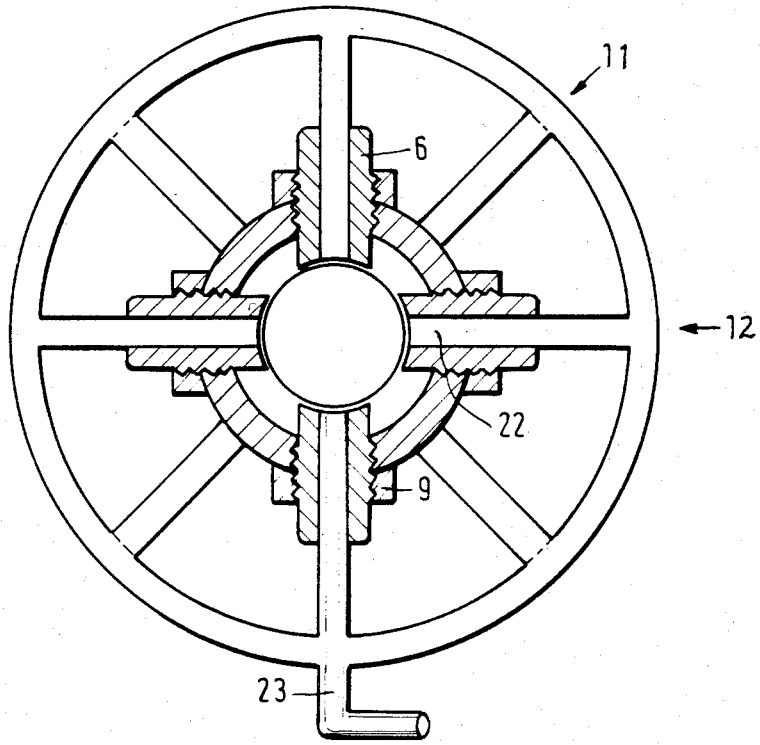
Fig.2

PRESS INSTALLATION

BACKGROUND OF THE INVENTION

The present invention concerns a press installation for the separation of the liquid components from the solid components of a mixture of liquids and solids.

An installation for pressing of mixtures of liquids and solids is disclosed in our U.S. Pat. No. 4,429,628 granted Feb. 7, 1984. This installation includes pins protruding through the press cylinder in which a press screw is mounted. The pins point radially toward the screw and are intended to prevent the rotation of the material to be pressed with the screw. An adequate conveying pressure is built up by means of the pins.

Axial drainage bores are provided in the pins. The drainage bores open toward the axis of the screw and connect with drainage pipes for draining the separated liquid immediately at the location of its release, without producing a significant loss of pressure due to the drainage orifices.

As mentioned above, the pins prevent the rotation of the material with the screw, so that a high transport yield and thus high pressure in the area of the pin cylinder are produced. The high pressure also releases the intercellular and intervolume water of organic material. This water may be removed in view of the high pressure head of, for example, 300 bars in the press cylinder and 1 bar (atmospheric pressure) in the drainage bore holes.

As the distance between the tips of the pins and the base of the screw thread is relatively small, for example 0.3 mm, only very small solid particles will be entrained in the separated liquid. These particles are of such a size that they do not clog the drainage bore holes. The tips of the pins conform in shape to the curvature of the screw core.

It was found that, with the press installation according to our above mentioned patent, high transport rates and thus a high pressure can be obtained. The high pressure buildup is generated primarily by the drainage pins extending radially into the cylinder space. These pins prevent the rotation of the material to be dehydrated with the screw.

The liquid separated from the mixture is removed from the closed dehydration system at two locations:

(a) the liquid located on the inner wall is drained off through radial bore holes provided in the back of the screw thread, which in turn are connected with an axial screw bore hole in the core of the screw; and (b) the separated liquid located in the base of the screw thread is removed by means of the axial drainage bores of the pins, with the pins terminating closely adjacent the core of the screw to form a parting gap. All drainage bore holes are connected with the drainage pipes.

It has now been determined that the transportation rate of the press installation is too high for certain materials, for example tree bark, and that consequently the dehydration retention time is too short, whereupon inadequately pressed material is discharged from the installation. It is therefore necessary to find ways to both extend the dehydrating retention time and also to increase the compression of the material in order to attain a higher degree of dehydration. This, however, should be accomplished without reducing the transportation rate, since this rate determines the productivity of the installation, and thus the economic viability of the system. As, however, the material compression depends to a great extent on the transportation rate, it is necessary to avoid a simple increase in the compression of the material.

SUMMARY OF THE INVENTION

It is an object of the present invention to provide a press installation having a high rate of transport and thus production.

Another object of the present invention is to provide a press installation wherein the retention time of the material to be pressed is relatively long.

A further object of the present invention is to provide a press installation which can achieve a high degree of dehydration.

An even further object of the present invention is to provide a press installation having pins with drainage bore holes wherein the proportion of solids arriving at the drainage bore holes of the pins should be as low as possible.

In the discharge zone, the screw is formed without threads, whereby presssure is increased only slightly in this zone. Primarily, presssure or transport capacity, respectively, is maintained, and it should be emphasized that a maintenance of pressure in this zone is equivalent to an increase in the work of compression. An increase in the work of compression on the other hand signifies a rise in press performance, which in turn is equivalent to an increase in the degree of pressing, i.e. in the dry substance content.

As no conveyor threads are present, the relative velocity between the material to be pressed and the inner wall of the cylinder and, respectively, between the material to be pressed and the drainage pins representing the flow resistance, is reduced. Thus, the time available for the drainage of the liquid released into the drainage bores is extended, without remixing.

This process is highly favorable with respect to the overall dehydration of the material. In the preceding intake zone, a high relative velocity between the material and the inner wall of the cylinder is present, so that the peripheral area of the material already is in a higher state of dehydration than the material zone around the core of the screw. Consequently, a certain equalization takes place in the discharge zone, whereby the overall degree of dehydration is further increased.

By means of an annular widening of the cross section in the discharge zone between the core of the screw and the inner wall of the cylinder, the material having an increasing dry substance content is discharged in spite of increasing solidification. Thus, a malfunctioning of the installation or even a stoppage of the screw is avoided. The operating performance of the installation is thus decisively affected.

In order to prevent in the discharge zone the penetration of small solid particles in the parting gap between the tips of the pins and the core of the screw, a step-like, radial offset, i.e. a reduction in the diameter of the core of the screw, is provided. Thus the tips of the pins form a deydrating parting gap with the core. Solid particles therefore cannot be pushed by the incoming material into the parting gap, as the latter is protected by the step-like offsets.

The pins may be radially offset from one pin plane to another. This radially offset arrangement of the pins of the successive individual pin planes assures that the material moved by the preceding transport zone into the discharge zone is entrained at all points. Thus, if the material is not engaged by one of the pin planes, it will be pressured against the staggered pins of the next pin plane, etc.

In order to effect a slow transport movement in the case of a very long discharge zone, it may be appropriate to arrange a plurality of conveyor elements obliquely to the axis of the screws on the screw core to promote movement of material between the individual pin planes.

BRIEF DESCRIPTION OF THE DRAWINGS

Examples of one embodiment of the invention will become apparent from the drawings.

In the drawings:

FIG. 2 shows a cross section on the line II—II in FIG. 1, and FIG. 3 shows an enlarged section of FIG. 1 identified by "X."

DETAILED DESCRIPTION OF THE PREFERRED EMBODIMENT

Figure 1:
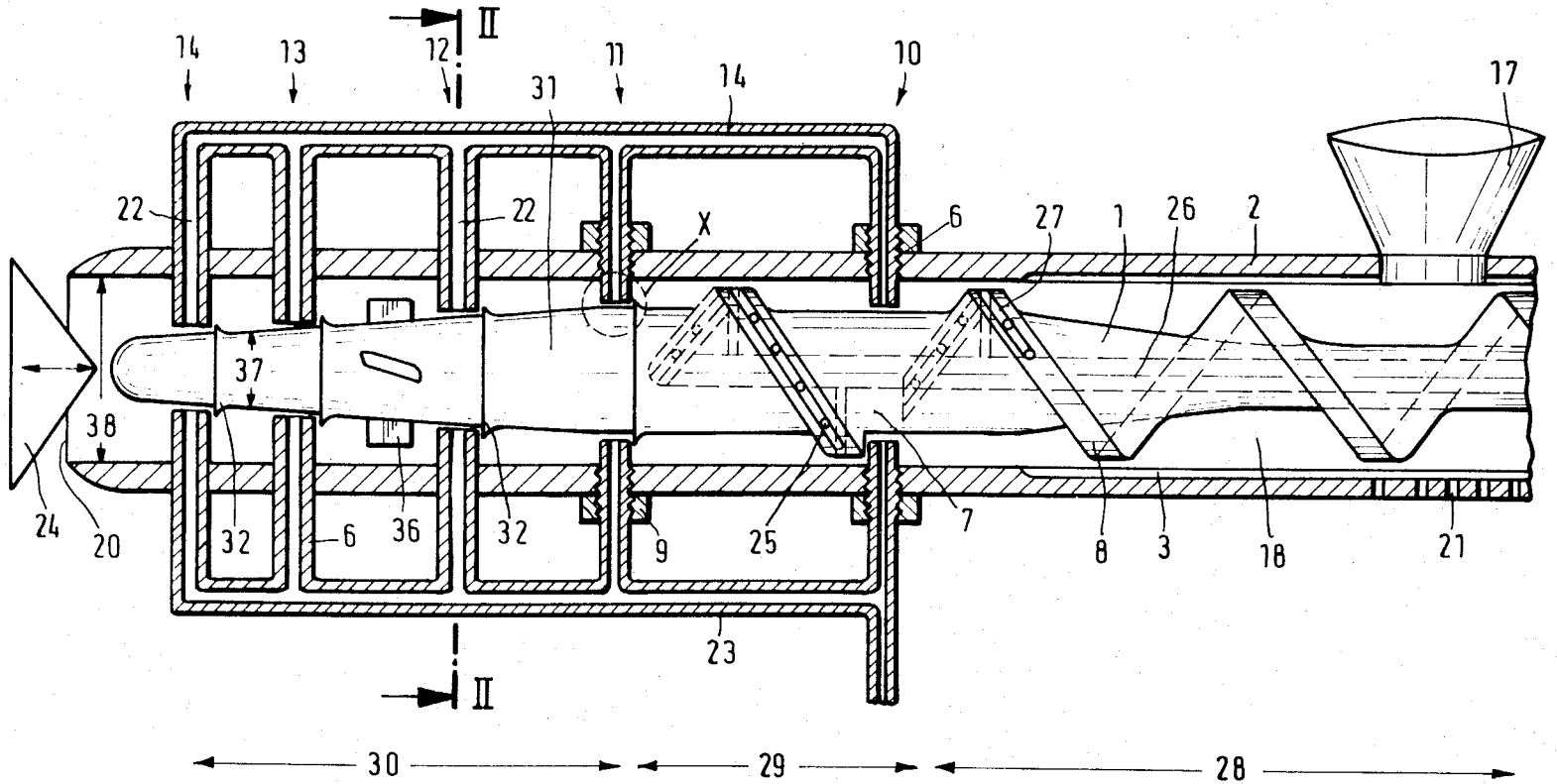
FIG. 1 shows a schematized longitudinal section through a preferred press installation.

Referring to FIG. 1, the press installation comprises a press screw 1 arranged in a press cylinder 2. The screw 1 is rotated by a drive unit (not shown), whereby the material to be pressed is transported forward to the discharge orifice 20.

A plurality of grooves 3 are formed on an inner wall of press cylinder 2. These grooves 3 extend in the direction of the screw axis and may have a triangular cross section, or other cross sections such as rectangular or semicircular.

In a pin cylinder zone 29, the press cylinder 2 is penetrated by pins 6 which extend radially in the direction of the screw axis. Pins 6 terminate at the base of the thread 8, or core, of the screw 1. The positions of pins 6 are correlated with a plurality of breaks 7 in the helical screw threads 8. Breaks 7 have a width corresponding to the diameter of the pins 6.

The pins 6 are screwed into the press cylinder 2 and secured in place by means of nuts 9. The individual pins 6 may be screwed into the press cylinder 2 to a depth so that the distance between the tip of the pins and the screw core may be varied. The pins 6 are combined into individual pin planes 10–14. The pin plane 12 is shown in cross section in FIG. 2 and in this case consists of four pins 6, although a greater number of pins than 6 may also be provided. The number of pins depends on the proportion of water in the material to be dehydrated. A plurality of axial drainage bore holes 22 are provided respectively in the pins 6, and are connected with the drainage pipe 23.

A mixture of liquids and solids is fed through a funnel 17 into a space 18 between portions of the screw thread 8 and transported by the rotating movement of the screw 1 in the direction of the outlet orifice 20.

In the intake area 28, the material undergoes its initial pressing, and the liquid which is more easily released flows out through strainer orifices 21. The material is then transported into the pin cylinder zone 29, where it is prevented from rotating with the screw by the pins 6 extending into the press cylinder 2. The material is briefly accumulated in front of the pins 6, whereby the pressure is increased on the screw thread until the material in the thread is moved forward by the mixture following it. This procedure continues at each pin plane until the compressed material arrives in the part of the cylinder not impeded by the pins 6.

The highest pressure is applied to the material to be pressed in the area of the pins, whereby the intercellular and intervolume water is released and a dry substance content of 50–85%, depending on the material, is obtained continuously.

The outlet orifice 20 is closed by means of a cone 24 under pressure. Only under a definite, predetermined pressure will the outlet orifice open. This measure effects an increase in pressure in the zone of the pin cylinder zone 29 and the discharge zone 30.

The most essential precondition of a high degree of dehydration of the mixture, however, is the placing of the drainage bore holes 22 axially in the pins 6. In this manner, the intercellular and intervolume water is separated due to the very high pressure, and the separated water is drained off at the positioned of its separation. It is decisively important to remove the liquid as soon as possible after it is separated. The liquid removal must take place at the position of separation in order to prevent any appreciable remixing to take place.

Also, the formation of the drainage bore holes 22 in the pins 6 makes it possible for the liquid to be separated and removed without an appreciable loss of pressure in the zones 29 and 30. The high pressure buildup is needed for the separation of the cell water so that high dry substance content may be obtained.

There is illustrated in FIG. 1, in addition to the intake zone 28 and pin cylinder zone 29 already described, a discharge zone 30. The discharge zone 30 has a screw section 31 free of threads. The core 37 of the screw tapers off in diameter in the working or forward direction, while the press cylinder 2 has a constant diameter 38. By means of this configuration, the free annular cross section between the core 37 and the inner wall 38 of the cylinder increases in size in the working direction. Thus, in case of an increase in the dry substance content, i.e. an increase in the solidified material, blockage of the screw 1 is prevented in an advantageous manner.

In the screw section 31 which is free of screw threads, an annular collar 32 is arranged in front of each of the pin planes 11–14. As seen in FIG. 3, the peripheal edge of each collar 32 extends radially well beyond the tips 33 of the pins 6. Thus, the parting gap 35 formed between the tips 33 of the pins and the bottom 34 is protected from the material being pressured toward the outlet orifice 20. In this manner, practically no solid particles arrive in the parting gap 35.

In FIG. 2, the staggered arrangement of the pins of the individual pin planes 11 and 12 may be seen. With this staggered arrangement, the material pressured toward the outlet orifice 20, if it has passed several pin planes, has been pressed at least once against a pin and has become dehydrated in the process.

In order to support the transport of the material in the case of a very long discharge zone 30, a plurality of agitator elements 36 may be arranged in the screw section 31, between the individual pin planes 11–14, in order to actively move the material. The length of the discharge zone depends on the humidity content and the dehydrability of the material to be pressed. By the oblique arrangement of the agitator elements 36, corresponding to the rise of the screw threads in the intake zone, the material is transported by the rotation of the screw and the successive planes of pins.

What is claimed is:

1. A press installation for the separation of liquid components from solid components of a mixture of liquids and solids, comprising:

a press cylinder;

a screw rotatably mounted in said press cylinder, said screw comprising a core and a helical screw thread arranged on said core at least a portion of the length thereof;

a plurality of pins penetrating radially through said press cylinder, said pins pointing toward the axis of said screw and extending to a position below said screw thread;

a plurality of breaks in said screw thread, said breaks corresponding in position with said pins such that, upon rotation of said screw, said pins pass through said breaks;

a plurality of axial drainage bore holes extending through said pins, respectively, and opening toward the axis of said screw;

a drainage pipe connected to said drainage bore holes;

a discharge zone in which said screw core is devoid of said screw thread, the construction of said core and said cylinder in said discharge zone being such that the free annular cross sectional area between said core and said cylinder increases toward the discharge end of said press, and a step-like annular offset formed on said core in said discharge zone in the vicinity of said pins, said offset having a bottom closely adjacent the radially inner ends of said pins, thereby forming therebetween a parting gap for the removal of the liquid released.

2. A press installation according to claim 1, wherein said core in said discharge zone is tapered in the working direction, and said press cylinder is cylindrical with a constant diameter.

3. A press installation according to claim 1, wherein said pins are arranged in a plurality of pin planes, and wherein the pins of the individual pin planes are arranged in a radially staggered manner from pin plane to pin plane.

4. A press installation according to claim 1 including a plurality of agitator elements arranged between individual pin planes on said core in said discharge zone.

5. A press installation according to claim 1, wherein said press cylinder in said discharge zone has a conically tapering inner diameter which increases in the working direction, and said core in said discharge zone has a constant diameter.

* * * * *